United States Patent [19]

Brocklehurst et al.

[11] 4,437,369

[45] Mar. 20, 1984

[54] SHEET MATERIAL CUTTING METHOD AND APPARATUS

[75] Inventors: Charles E. Brocklehurst; Bruce H. Cooper, both of Fountain Inn, S.C.

[73] Assignee: Opelika Manufacturing Corporation, Chicago, Ill.

[21] Appl. No.: 399,709

[22] Filed: Jul. 19, 1982

[51] Int. Cl.[3] ..... D06H 7/02

[52] U.S. Cl. ..... 83/18; 83/42; 83/83; 83/175; 83/209; 83/364; 83/367; 83/371; 226/33

[58] Field of Search ..... 83/18, 42, 56, 83, 175, 83/209, 210, 364, 365, 367, 371, 436; 226/33, 88

[56] References Cited

U.S. PATENT DOCUMENTS

| | | | |
|---|---|---|---|
| 695,553 | 3/1902 | Heany | 83/371 |
| 714,825 | 12/1902 | Shelain | 83/371 |
| 2,077,439 | 1/1931 | Schmitt | 164/42 |
| 2,458,612 | 1/1949 | Luzzatto et al. . | |
| 2,966,086 | 12/1960 | Sjöstrom | 83/175 |
| 3,029,675 | 4/1962 | Alexander et al. | 83/371 X |
| 3,246,816 | 4/1966 | Dexter et al. | 83/371 X |
| 3,289,507 | 12/1966 | Grewe | 83/74 |
| 3,318,179 | 5/1967 | Elsas . | |
| 3,699,832 | 10/1972 | Smith et al. | 83/210 |
| 3,948,125 | 4/1976 | Hujer et al. | 83/62 |
| 4,034,634 | 7/1977 | Arbter | 83/18 |
| 4,375,175 | 3/1983 | Elsas et al. | 83/18 |
| 4,397,205 | 8/1983 | Kirstein | 83/364 |

*Primary Examiner*—Frank T. Yost
*Attorney, Agent, or Firm*—George M. Thomas

[57] ABSTRACT

Sheet material 14, such as a continuous supply of terry cloth towel 16, is moved along its length through a path and toward a cutting station 15 where it is cut into lengths 139. The sheet material is formed with bands 166 extending across its length, such as bands of reduced thickness, and the sheet material is cut in these bands. The bands are detected by rollers 144, 145 at opposite edges of the sheet material as the bands approach the cutting station 15, and each edge portion of the sheet material is fed by feed rollers 51, 52 independently of the other edge portion into the cutting station so as to cause one side of the sheet material which may lag the other side to be properly located at the cutting station prior to cutting the sheet material. The sheet material is pulled taut across its length by cylinders 155, 156 at positions straddling the cutting station and on opposite sides of the longitudinal centerline of the sheet material so that the filler threads of the sheet material are induced to extend at a right angle with respect to the longitudinal centerline of the sheet material, and the cut is then made across the sheet material.

15 Claims, 7 Drawing Figures

178
179
132
180
CR1
182
181
133
PB2-1
CR2
184
CR1-1
PB1
CR2 A
185
CR2-1
L3
CR9
189
CR7-1
CR2-2
TR1
188
186
TR1
190
CR3
191
PB3
PB5-1
129
N/C
SV-1
PB5-2
129
N/O
194
SV-2
192
CR3-NC
117
193
CR3-NO
67
CR8-1
CR2A-1
TR2
198
196
TR2-1
CR4
199
MATCH LINE
178
MATCH LINE
179
PB4
PB6-1
206
128
N/C
SV-3
204
PB6-2
N/O
SV-4
205
128
CR4-NC
201
110
200
CR4-NO
202
64
CR7-2
CR8-2
CR2A-2
SV-5
209
210
TR3
211
TR3-1
TS1
CR5
PB7
79
CR5-NC
212
CR5-NO
65
213
CT1
214
SV-6
32
215
SV-7
12V
219
CTR 1
CTR 3
CR7
CTR 2
CTR 4
CR8
220
PB2-2
219
218
78

SHEET MATERIAL CUTTING METHOD AND APPARATUS

BACKGROUND OF THE INVENTION

This invention relates to a sheet material cutting method and apparatus wherein sheet material is taken from a supply and advanced along its length to a cutting station, and is cut across its length. More particularly, the invention relates to a system for cutting terry cloth towel and similar sheet material having bands extending across its length of different character than the remaining sheet material, such bands being of different thickness, different color or other texture. The process includes the steps of feeding the sheet material toward a cutting station, detecting the bands as they approach the cutting station at opposite side portions of the sheet material and stopping the movement of each side of the sheet material independently of the other side so that each side portion of the sheet material is precisely postioned at the cutting station. The sheet material is then stretched across the cutting station so as to assure that the filler threads of the sheet material are properly oriented at the cutting station, and a cut is made through the sheet material while the sheet material is stretched.

In the manufacture of terry cloth towels and other flat goods, it has been difficult to accurately cut the goods from a continuous supply into short lengths with the cuts being formed at the proper location in the goods. For example, a popular design for terry cloth towels is to have the main body of the terry cloth towel include a plush surface of terry cloth, and then at the ends of the towel to have several bands of lesser thickness and of different lengths adjacent a hem or fringe. The terry cloth towel material is woven in a very long length, and the supply of the terry cloth towel material must be cut across its length to form the individual towels, etc.

The terry cloth towel material has been cut by hand, by a worker moving the towel material along a work surface, locating the thin bands of the towel material, and then moving a motorized cutting implement with a rotatable disc and cutting with the disc through the thin bands of the towel material to cut the material. This is a slow operation, requires a skilled worker, and occasionally results in an improper cut being made.

Another prior art apparatus for cutting terry cloth towel and the like with thin bands extending across the material into lengths of toweling includes an automated cutter wherein the supply of towel material is fed toward a cutting station between a pair of parallel rotatable rollers that are spaced apart a distance that prevents the rotation of the rollers from moving the thin portions of the material. When a thin band on the towel material is detected, the rollers are operated to run in the reverse direction and the rollers move the thick part of the material backwards along the feed path until the thin portion of the material is located between the feed rollers. This locates the thin portion of the material at the cutting station and a cut is made across the material a predetermined distance from the rollers. While this type of equipment functions to make a cut through the towel material at the thin bands of the material, the equipment operates at a relatively slow speed, and the equipment does not work well on relatively thin terry cloth material. Moreover, some terry cloth material is likely to have a pattern of thin bands extending across the material so that the towel cut from the material has a design at its opposite ends of alternating long and short bands of thin material. It is difficult for the prior art automatic cutting equipment to distinguish between the long and short thin bands so as to make the cut in the long thin band and not in a short thin band. Also, the prior art cutting equipment cannot determine the difference between a properly formed thin band extending across the sheet material and a flaw extending across the sheet material.

Another prior art towel cutting device comprises a detecting system for locating bands formed in the terry cloth material that include no filler threads, so that when a cut is made through these thin bands a towel with a loose fringe is formed. The detection equipment includes a feeler that tends to fall through the areas of the towel material that have no filler threads so as to locate the proper portion of the towel material to make the cut. The detector tends to accumulate thread, lint and debris and to become inoperable after the system has been operated for some period of time. Also, the detection system has not proven to be 100% reliable in that slack in one edge portion of the towel material caused by non-uniform weaving of the material tends to cause an incorrect cut across the material.

In general, when the supply of towel material is fed to a cutting station, the material must have the proper thin band, usually the longest of the thin bands, positioned at the cutting station before the cut can be made. One edge portion of the towel material might be fed slightly ahead of the opposite edge portion, and it is desirable for the equipment to adjust the edge portions of the material at the cutting station so that the ends of the filer threads are parallel to the path of the cutting equipment, or the cutting equipment will make a cut that is not parallel to the filler threads of the material. Moreover, even if the opposite edge portions of the supply of towel material are properly aligned with respect to each other at a cutting station, it is likely that there will be some sag in the filler threads at the center portion of the towel material, where the filler threads are curved forwardly or rearwardly along the length of the material from the opposite edges of the material. If a straight cut is made across the material while the sag has not been removed from the filler threads, several of the filler threads will be cut intermediate their ends. This results in an improperly formed product. Therefore, it is desirable to stretch the material across its length at the cutting station to straighten the filler threads as the cut is made.

SUMMARY OF THE INVENTION

Briefly described, the present invention comprises a sheet material cutting method and apparatus which is constructed to move a supply of sheet material that includes bands of a different character from the main body of the sheet material that extend across the length of the sheet material, and to locate the bands at a cutting station so that a cut can be made through the bands. The system advances the sheet material at its opposite edge portions with drive rollers that engage the opposite edge portions of the sheet material, and the bands approaching the cutting station are also detected at the opposite side portions of the sheet material. The operation of each drive roller is independently terminated in response to the detection of the oncoming band of a predetermined length, to locate each side portion of the oncoming band at the cutting station. The side portions of the sheet material are grasped at the cutting station and are pulled away from the longitudinal centerline of the sheet material to stretch the sheet material, thereby tending to straighten the filler threads, and the cut is made with the sheet material in its stretched condition.

Thus, it is an object of this invention to provide a sheet material cutting method and apparatus wherein sheet material having bands extending across its length of a different character than the main body of the sheet material is advanced toward a cutting station, the bands approaching the cutting station are detected at opposite side portions of the sheet material, and each side portion of the sheet material is independently moved to the cutting station so as to assure that the opposite side portions of the band of the proper length are precisely located at the cutting station.

Another object of this invention is to provide a sheet material cutting method and apparatus which properly locates the opposite edge portions of a thin band in the sheet material at a cutting station and then stretches the sheet material so as to straighten the filler threads, and then cuts through the sheet material at the thin band.

Another object of this invention is to provide a method and apparatus for cutting sheet material which is reliable over prolonged operational periods to accurately cut the sheet material into lengths that correspond to the positions of bands of different character extending across the sheet material.

Another object of this invention is to provide a sheet material cutting method and apparatus which accurately cuts across fringe bands and thin bands in the sheet material by distinguishing between the short and long bands, orienting the bands at a right angle with respect to the longitudinal centerline of the sheet material and cutting through only the long bands.

Another object of this invention is to provide an automatic sheet material cutting method and apparatus which cuts sheet material such as terry cloth towels having bands of a lesser thickness than the rest of the sheet material with the bands extending across the sheet material and with some of the bands being of a different length than others of the bands, with the sheet material being cut through the longer bands.

Other objects, features and advantages of the present invention will become apparent upon reading the following specification, when taken in conjunction with the accompanying drawings.

DETAILED DESCRIPTION OF A PREFERRED EMBODIMENT

Figure 1:
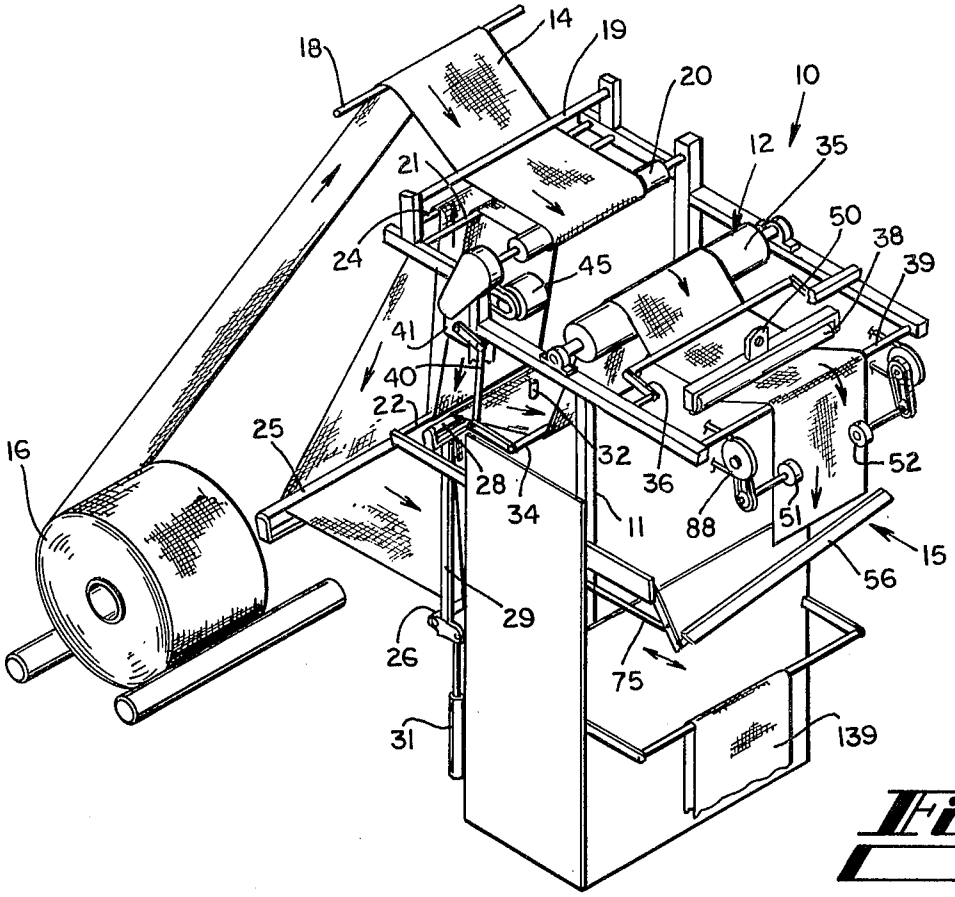
FIG. 1 is a perspective illustration of the sheet material cutter.

Referring now in more detail to the drawings, in which like numerals indicate like parts throughout the several views, FIG. 1 illustrates the sheet material cutter or towel cutter 10 that includes a supporting framework 11 that supports a sheet conveying system 12 that feeds the supply of the sheet material 14 first downwardly then upwardly with respect to the backside of the framework, across the top of the framework, and then down the front of the framework where the cutting mechanism 15 is located.

The sheet material 14 is taken from a reel 16 or similar supply such as an accordian-folded supply of the sheet material, and the free end portion of the sheet material is fed first upwardly over a stationary guide roller 18 supported from the ceiling structure, etc., then beneath stationary guide roller 19, and about drive roller 20. The sheet material then moves over stationary guide roller 21, downwardly through dancer arm 22, then upwardly over stationary guide roller 24. The material then moves in a U-shaped path downwardly first about guide roller 25, then horizontally to guide roller 26, then upwardly to guide roller 28. Guide rollers 26 and 28 are supported by tiltable frame 29, and frame 29 is mounted on horizontally-extending axle 30. The frame is tilted about axle 30 by fluid-actuated cylinder 31. Photoelectric cells 32 are located at opposite edges of the path of the sheet material as the sheet material moves horizontally away from guide roller 28, and the photo cells control the operation of fluid-actuated cylinder 31, so as to tilt guide rollers 26 and 28 about axle 30, to move the sheet material laterally with respect to its path of movement, thereby guiding and controlling the sheet material as it moves across the top of the framework 11.

The sheet material moves horizontally from guide roller 28 around the lower portion of guide roller 34, then upwardly about drive roller 35, downwardly and about dancer arm 36, beneath tiltable tension balance bar 38, over guide roller 39, and then downwardly through the cutting mechanism 15.

Dancer arms 22 and 36 (FIG. 2) are tiltable, with one end portion being received in the slack of the sheet material and the other end portion being supported in a pivot, and with a crank arm connected between the dancer arm and a variable speed transmission. For example, dancer arm 22 includes crank arm 40 and variable speed transmission 41 while dancer arm 36 includes crank arm 42 and variable speed transmission 44. Motor 45 drives variable speed transmission 41, and drive belt 46 extends from transmission 41 to drive drive roller 20. Variable speed transmission 44 is driven by drive belt 121 from the main drive system of the towel cutter, and the drive belt 49 extends from the variable speed transmission to drive the drive roller 35.

Tiltable tension balance bar 38 is supported from the framework and the sheet material passes beneath the balance bar. The balance bar is tiltable from its clevis 50, so that if one edge portion of the sheet material is pulled tighter than the other edge portion, the balance bar will tilt and apply tension to both edges.

The sheet material is pulled downwardly across the front of the framework 11 by a pair of drive rollers 51 and 52 toward the cutting blade 56 which is located at the cutting station 54 below the drive rollers. The drive rollers are urged against a backing plate 55 so that the sheet material is clamped between the drive rollers and the backing plate as the drive rollers rotate and pull the sheet material downwardly across the cutting station 54.

Figure 2:
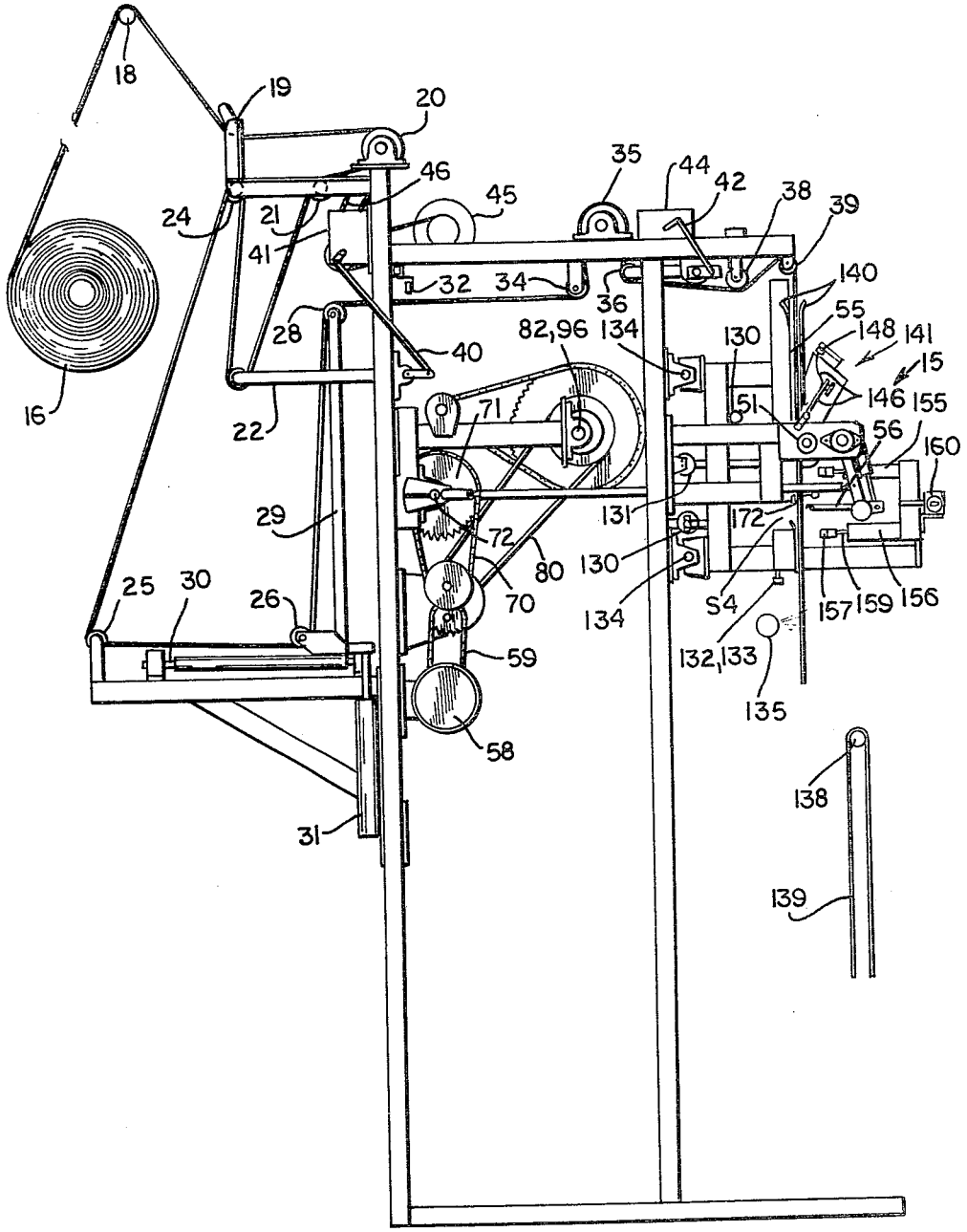
FIG. 2 is a side elevational view, with portions removed, of the sheet material cutter.
Figure 3:
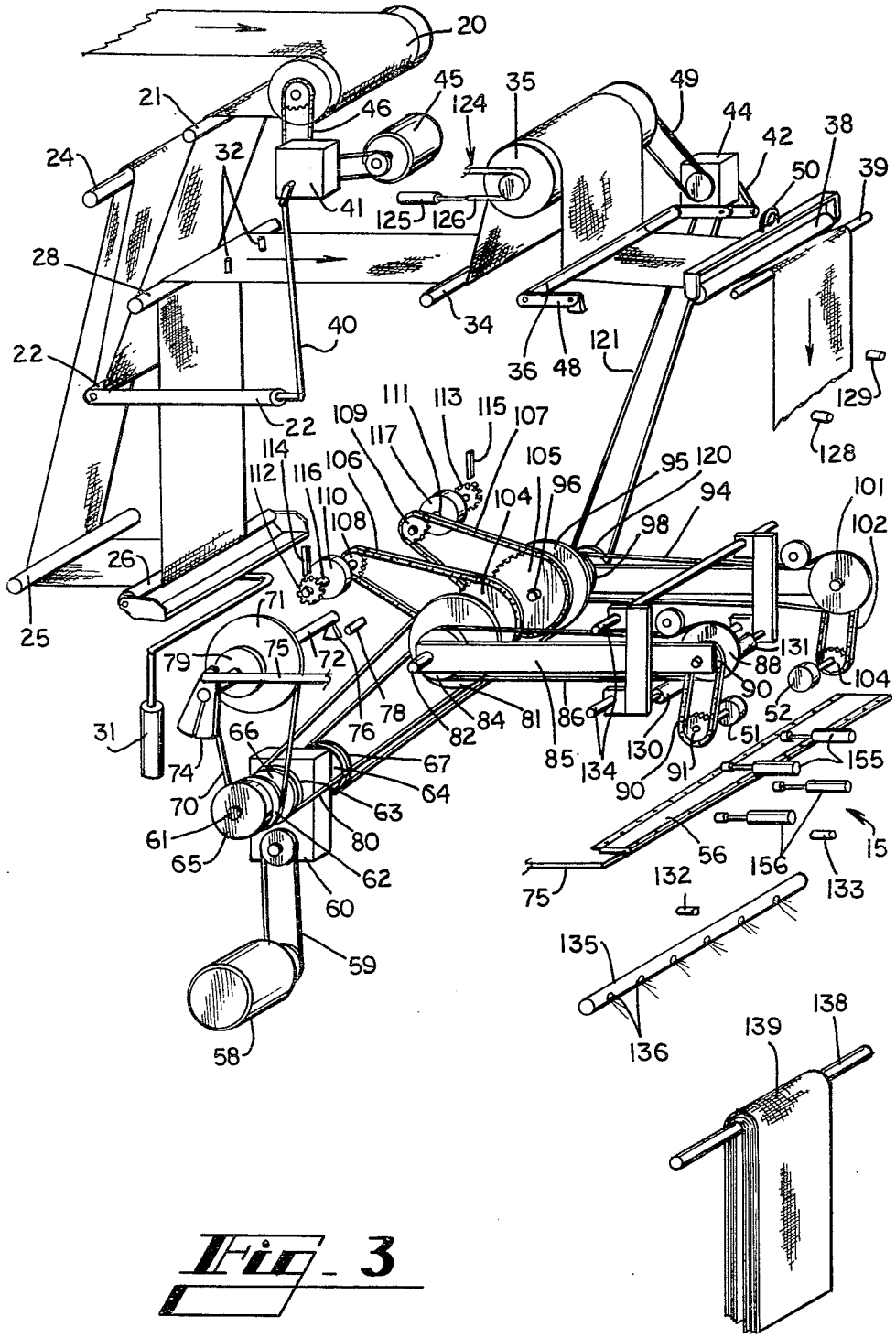
FIG. 3 is a perspective schematic illustration of the sheet advancement conveyor and of the drive system which drives the conveyor and the cutting mechanism.
Figure 4:
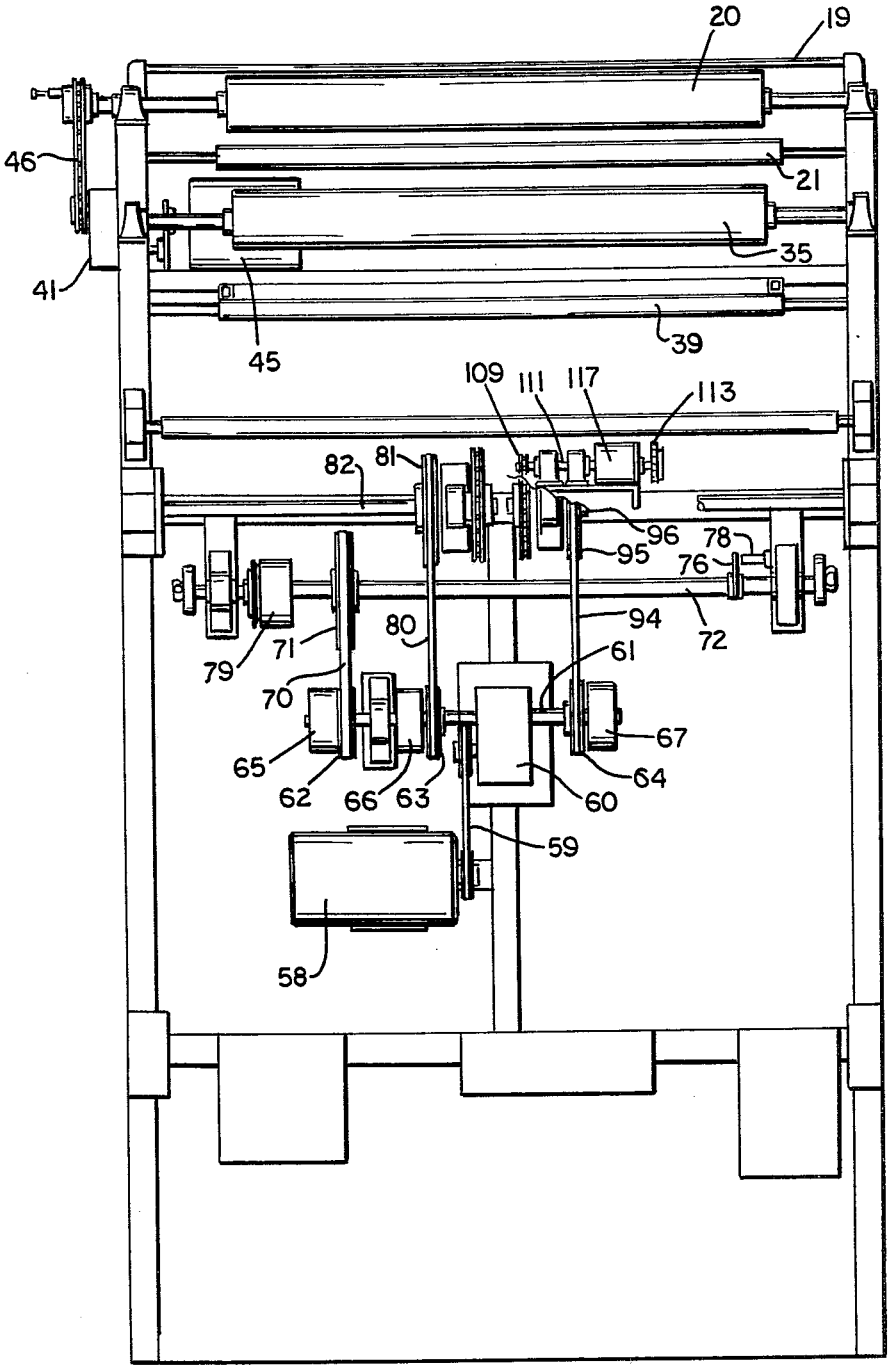
FIG. 4 is an end cross-sectional view of the sheet material cutter, with portions removed so as to illustrate the drive system.

As best illustrated in FIGS. 2, 3 and 4, the main drive system for the towel cutter includes motor 58 which includes a drive belt 59 that drives a pulley of a gear box 60. Gear box 60 drives drive shaft 61, and driven sheaves 62, 63 and 64 are releasably connected to drive shaft 61 by their respective clutches 65, 66 and 67. Driven sheave 62, through its drive belt 70 rotates sheave 71 mounted on blade drive axle 72, and axle 72 rotates crank arm 74. Crank arm 74 is connected to connecting rod 75 which extends forwardly of the framework for driving cutting blade 56. Also mounted to axle 72 is lobe 76 that rotates in front of photoelectric cell 78. Photoelectric cell 78 controls clutch 65 and brake 79 which are mounted to axle 72, for the purpose of starting and stopping crank arm 74 and the reciprocation of connecting rod 75. Thus, clutch 65 is actuated to begin the rotation of axle 72 and the reciprocation of connecting arm 75, and simultaneously with disengaging clutch 65 the brake 79 engages to stop the reciprocation of connecting rod 75.

From this point on, the main drive system is separated, with one half being arranged to drive one of the drive rollers 51 and the other half being arranged to drive the other drive roller 52. Driven sheave 63, through its drive belt 80 drives the sheave 81 mounted to driven shaft 82. Driven shaft 82 is slotted, and movable sheave 84 is keyed to the slot of the shaft 82. Movable sheave 84 is also mounted to support arm 85, and the support arm can move sheave 84 along the length of shaft 82, as will be explained in more detail hereinafter.

Movable sheave 84, through its drive belt 86 rotates sheave 88 at the front of the framework. Sprocket 89 is mounted to sheave 88, and drives timing chain 90. Timing chain 90 drives sprocket 91, and sprocket 91, through an axle, drives feed roller 51.

The other half of the drive system is substantially the same, and includes a drive belt 94 extending from driven sheave 64 to sheave 95, with sheave 95 being keyed to slotted shaft 96. Support arm 99 is also attached to the movable sheave 98. Movable sheave 98, through its drive belt 100 rotates sheave 101 at the front of the framework. A sprocket is mounted to sheave 101 and drives timing chain 102. Timing chain 102 drives procket 104, and sprocket 104, through an axle, drives feed roller 52.

Each slotted shaft 82 and 96 has a sprocket 104 and 105 keyed thereto, and each sprocket drives a timing chain 106 and 107 that rotates a sprocket 108 and 109. The sprockets 108 and 109 rotate an axle 110 and 111, respectively, and a sensing gear 112 and 113 is mounted to the axle 110 and 111 respectively. A proximity sensor 114 and 115 is placed adjacent each sensing gear 112 and 113, so as to detect the movement of the teeth of the gear as the gear is rotated. Also mounted to each shaft 110 and 111 is a brake 116 and 117 which positively stops the rotation of each shaft 110 and 111 and the keyed shafts 82 and 96.

With this arrangement, the motor 58 functions to operate feed rollers 51 and 52 in response to the engagement of their respective clutches 66 and 67, and their rotation is stopped by the disengagement of their clutches and the engagement of brakes 116 and 117. Clutches 66 and 67 and brakes 116 and 117 are controlled by proximity sensors 114, 115 detecting the movement of the teeth of sensing gears 112 and 113.

Drive roll 35 is driven from motor 58 through driven sheave 64, its drive belt 94, driven sheave 95, slotted axle 96, drive pulley 120 mounted on slotted axle 96, and belt 121 which extends from drive pulley 120 to variable speed transmission 44. In order that drive roll 35 stop promptly without having its inertia continue the movement of the sheet material through the system, a brake 124 is applied to the drive roll, with a fluid-actuated cylinder 125 arranged to place brake strap 126 under tension, with the brake strap 126 extending about the axle of the drive roll 35.

Photo cells 128 and 129 are located in front of the towel cutter 10 to detect the presence and absence of the opposite edge portions of the sheet material as the sheet material moves downwardly toward the cutting station. Photo cells 128 and 129 control fluid-actuated cylinders 130 and 131 that are mounted to the support arms 85 and 99 that support the movable sheaves 81 and 98 inside the framework and the sheaves 88 and 101, their sprockets 91 and 104, and drive rollers 51 and 52 at the front of the framework. When, for example, photo cell 129 detects the absense of the edge portion of the sheet material being fed toward the cutting station, the photo cell and the drive roller 52 are moved inwardly toward the centerline of the sheet material by cylinder 131. Conversely, when the photo cell 129 detects the presence of the edge portion of the sheet material, it controls cylinder 131 so as to push drive roller 52 and its related components away from the centerline of the sheet material. With this arrangement, drive roller 52 will always be maintained just inside the edge portion of the sheet material. In a like manner, drive roller 51 is controlled by the other photo cell 128 and its fluid-actuated cylinder 130, so that the drive roller 51 will always be maintained just inside the left edge portion of the sheet material as the sheet material is pulled by the drive roller toward the cutting station.

Another pair of photo cells 132 and 133 are located below the cutting station so as to detect the presence and absence of the sheet material as the towel cutter 10 operates. Should the photo cells 132 and 133 fail to detect the movement of a cut towel through the system as the system operates, these photo cells will terminate the operation of the system, as will be explained in more detail hereinafter.

In order that the segments of the sheet material cut by the towel cutter be stacked in an orderly manner after having been cut, an air conduit 135 is located below the cutting station, and includes a plurality of air ports 136 therein for directing a flow of air outwardly over a stacking rail 138. Thus, as a cut segment 139 of the sheet material falls from the cutting station, a blast of air flips the cut segment across the stacking rail, so that the individual cut sheets 139 are draped across the stacking rail.

Figure 5:
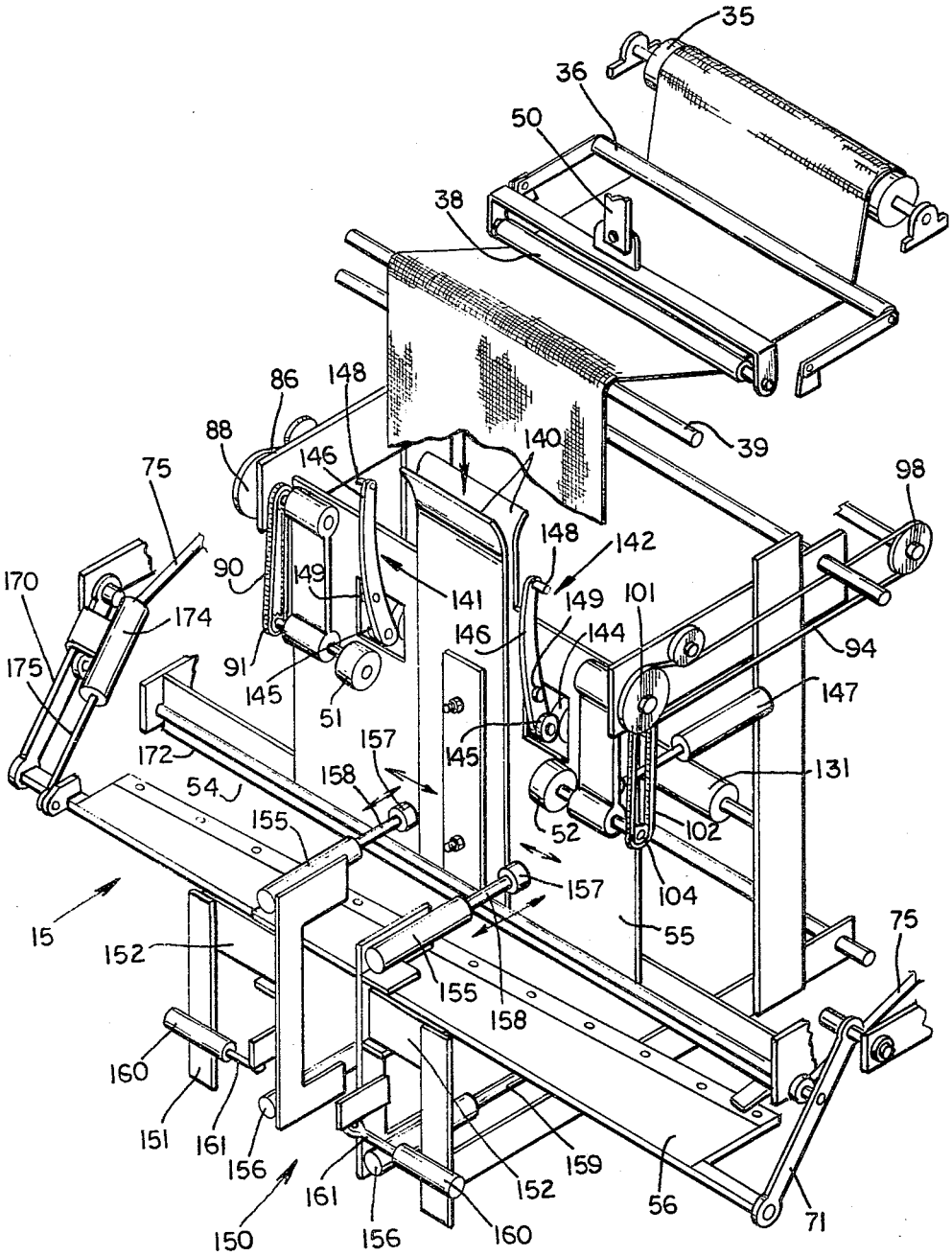
FIG. 5 is a schematic perspective illustration of the cutting mechanism at the front of the machine.

Referring now to FIG. 5, the continuous sheet material 14 moves downwardly from guide roller 39 in front of backing plate 55, between the infeed guides 140, toward the cutting station 54. Drive rollers 51 and 52 are urged toward the backing plate 55 against the sheet material by torsion springs (not shown), so that the sheet material is drawn downwardly at its opposite edge portions by the drive rollers. Just above each drive roller 51 and 52 is a sensing means 141, 142, and each sensing means includes a base roller 144, movable roller 145, roller support arm 146, and photo detector cell 148. The roller support arm 146 is pivoted on support 149, and a torsion spring biases the movable roller 145 toward engagement with base roller 144. The upper end portion of roller support arm 146 moves in front of photo cell 148, so that when the sheet material 14 passes downwardly between the movable roller 145 and its base roller 144, forcing the rollers apart, the upper end portion of the roller support arm 146 moves into and out of registration with photo detector cell 148, indicating the thickness of the sheet material passing between the rollers.

Since the sensing means 141 and 142 are located on opposite sides of the path traveled by the sheet material 14, the sensing means detect the varying thickness of the sheet material at the opposite edge portions of the sheet material. The photo detector cells 148 initiate the circuit (disclosed in more detail hereinafter) to the proximity sensors 114 and 115 of sensing gears 112 and 113, and the drive rollers 51 and 52 continue to rotate and pull the edge portions of the sheet material downwardly to the cutting station until the proximity sensors detect the movement thereby of a predetermined number of teeth of the sensing gears 112 and 113, whereupon the rotation of the drive rollers 51 and 52 is terminated by the actuation of the brakes 116 and 117. When the brakes 116 and 117 have been applied, push cylinders 147 are actuated to push the feed rollers 51 and 52 out of engagement with the sheet material.

With this arrangement, if the sheet material includes bands extending across its length of different thickness, and if one edge portion of a band leads the opposite edge portion during their movement toward the cutting station, the leading edge portion of the sheet material will move only the predetermined distance beyond the sensing means 141 or 142 so that it is stopped at the cutting station, while the opposite edge portion of the band will continue to advance toward the sensing means 141 or 142, and then will advance only its predetermined distance to the cutting station. This properly locates both edge portions of the sheet material precisely at the cutting station, in alignment with the cutting blade 56.

Stretching mechanism 150 straddles cutting blade 56 and is positioned so as to straddle the longitudinal centerline of the sheet material, to engage the sheet material at its opposite edge portions. Stretching mechanism 150 is constructed in similar left and right sections, with each section including a support framework 151, a hinge 152 supported on the framework 151, and a pivotable cylinder support 154 mounted on hinge 152. The hinge is oriented vertically so that te pivotable cylinder support 154 pivots about a vertical axis. Upper and lower sheet engagement cylinders 155 and 156 are each mounted on the pivotable cylinder support 154, and their cylinder rods 158 and 159 move back and forth toward engagement with the backing plate 55, and with the sheet material 14 extending downwardly across the backing plate. The feet or cushions 157 mounted on the ends of the cylinder rods tend to grip the sheet material against backing plate.

Pivot cylinders 160 are mounted to each support framework 151 and their cylinder rods 161 are connected to the pivotable cylinder supports 154, so that movement of the cylinder rods 161 causes the pivotable cylinder supports 154 and the sheet engaging cylinders 155 and 156 to pivot with respect to the hinge 152, causing the cylinder rods 158 and 159 and their feet 157 to sweep back and forth against backing plate 55. Therefore, when the sheet material 14 has been moved downwardly across the cutting station and upper lower sheet engaging cylinders 155 and 156 have been actuated to distend their cylinder rods into engagement with the sheet material, the push cylinders 147 move the drive rollers away from the sheet material, and the pivot cylinders are actuated to distend their cylinder rods 161, causing the cylinder rods of the sheet engaging cylinder 155 and 156 to sweep outwardly against the backing plate 55, causing the sheet material to be pulled taut or stretched across the cutting station.

When the opposite edge portions of the sheet material have been properly positioned at the cutting station, the stretching of the sheet material tends to induce the filler yarns to extend at a right angle with respect to the longitudinal centerline of the sheet material. After the sheet material has been stretched in this manner, the cutting blade 56 is actuated, by reciprocating the connecting arm 75 and pulling the cutting blade across the sheet material, causing the sheet to be cut.

Figure 6:
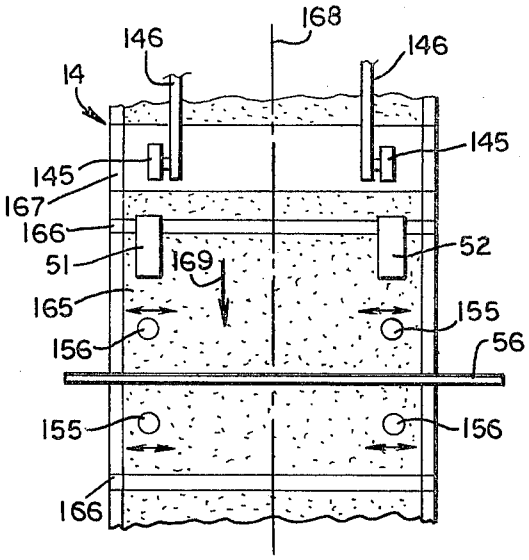
FIG. 6 is a schematic view of a portion of terry cloth sheet material, showing its bands of lesser thickness extending across its length.

As illustrated in FIG. 6, when the sheet material 14 is, for example, terry cloth and includes large plush areas of relative thickness 165 and bands 166 and 167 which are relatively thin, and when the sheet material is advanced downwardly by drive rollers 51 and 52 as indicated by direction arrow 169, the movable rollers 145 are urged into engagement with the sheet material and move back and forth toward and away from their base rollers 144 by the passage therebetween of the thick and thin areas of the sheet material. This causes a movement in the distal end portions of their respective roller support arms 146, so that the support arms 146 move in front of the photo detector cells 148, thereby providing a signal that controls the stopping and cutting functions. If one edge portion of the sheet material should lead the opposite edge portion, the thin band will be detected first at the one edge portion of the sheet material by the one sensing means and the one edge portion will be advanced from the one sensing means the predetermined distance to the cutting station while the opposite edge portion will continue its movement until its sensing means detects the presence of the other end of the thin band, whereupon the other edge portion of the sheet material will be moved only its predetermined distance to the cutting station. When one of the shorter bands 166 is detected by the sensing means, the control system will not actuate the stop function and cutting function. When the sheet material stops at the cutting station, the upper and lower sheet engaging cylinders 155 and 156 engage the sheet material on opposite sides of the cutting blade 56 and on opposite sides of the longitudinal centerline 168 of the sheet material and pull the edge portions of the sheet material away from the longitudinal centerline 168.

As illustrated in FIGS. 2 and 5, the end portions of the cutting blade 56 are connected to lever arms 170 and 171, with the upper end portions of the lever arms being pivotably mounted in the framework, and the connecting arms 75 are connected at their forward ends to the lever arms, and upon reciprocation of the connecting arms 75, the lever arms 170 and 171 oscillate to bring the cutting blade 56 into sliding engagement with the cutting edge 172, causing a scissors action to take place. The cutting blade 56 is slightly angled so as to create a progressive cut as it moves inwardly into the cutting station. Fluid-actuated cylinder 174 is mounted to one of the lever arms 170 and its cylinder rod 175 is connected to the back edge portion of the cutting blade 56, so as to continuously bias the cutting blade into engagement with the cutting edge 712, so that wear on the cutting blade or on the cutting edge will have minimal effect on the cutting function of the cutting blade.

Figure 7:
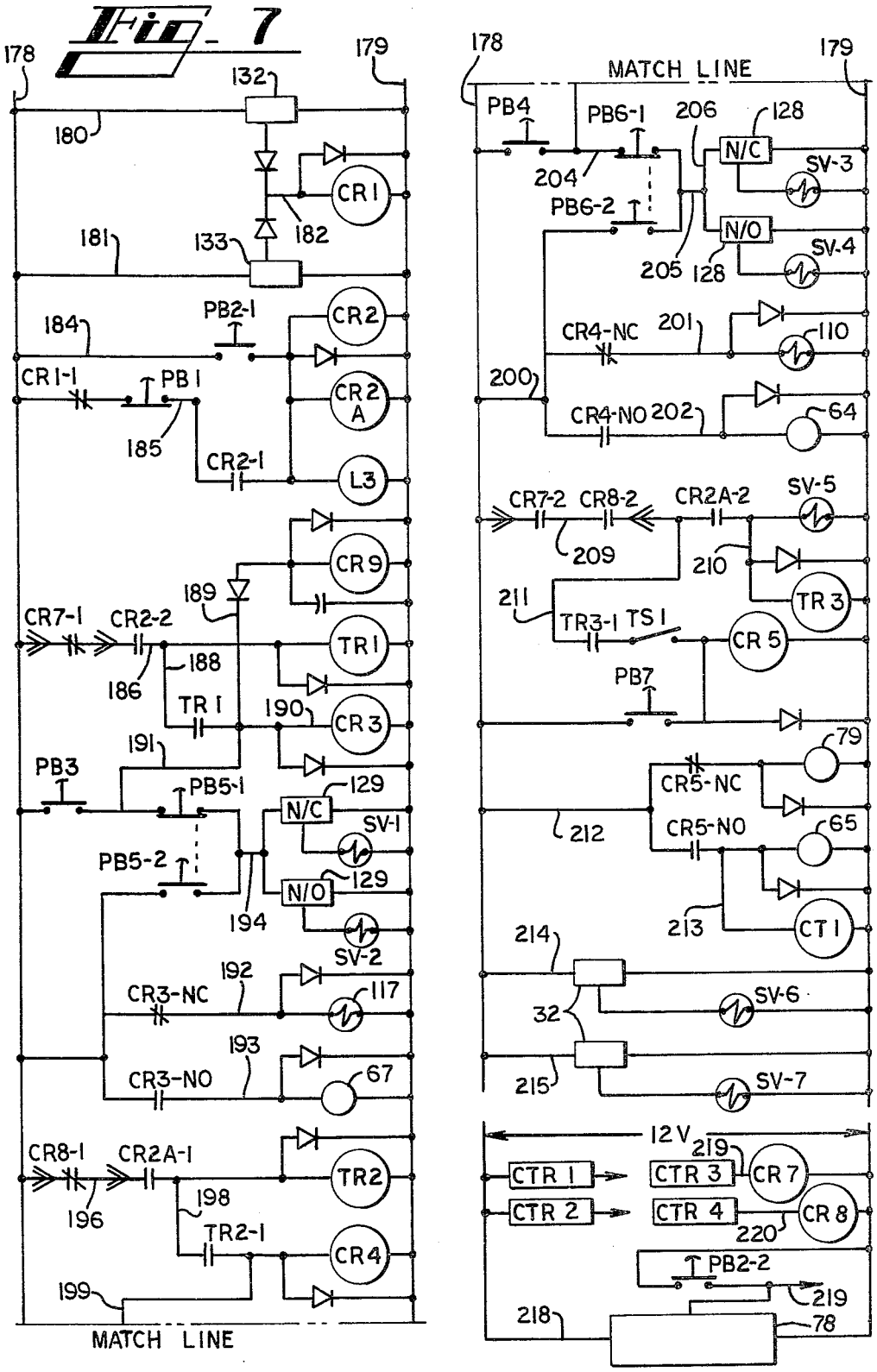
FIG. 7 is an electrical schematic of the control system for the sheet material cutter.

As illustrated in FIG. 7, the control circuitry for the towel cutter includes negative and positive 24 volt conductors 178 and 179 and the stop-motion photo cells 132 and 133 are connected between conductors 178 and 179 by conductors 180 and 181. When either one of the stop-motion photo cells 132 or 133 transmits a signal to conductor 182, the control relay CR1 opens its normally closed relay switch CR1-1 to terminate the operation of the towel cutter.

Normally open start switch PB2-1 is located in conductor 184, and when manually closed, energizes control relay CR2. Control relay CR2 closes its relay switch CR2-1 which forms a holding circuit through normally closed stop-motion switch CR1-1, normally closed stop button PB1, and the relay switch CR2-1.

Control relay CR2 closes its relay switch CR2-2 in conductor 186, so that a circuit is made along conductor 186 through normally closed relay switch CR7-1, relay switch CR2-2, and time-delay relay coil TR1. After a time delay, time-delay relay coil TR1 closes its relay switch TR1, making circuits through conductor 188, TR1, conductor 189 and control relay CR9, and through conductor 190 and control relay CR3, and through conductor 191. When the control relay coil of CR9 is energized, its switch is closed and energizes the unwinding mechanism, for feeding the sheet material to the towel cutter. When a circuit is made through conductor 190 to control relay CR3, its normally closed switch CR3-NC is opened and its normally open switch CR3-NO is closed. This opens a circuit through conductor 192 to the solenoid valve that actuates brake 117 and makes a circuit through conductor 193 to clutch 67. In the meantime, when a circuit is made through the time-delay switch TR1 to conductor 191, push-button PB5-1, conductor 194, to the scanners 129, and the scanners 129 detect the lateral movement of the sheet material so as to control the solenoid valves SV-1 and SV-2 which control fluid-actuated cylinder 131 to shift the right drive roller closer in toward the centerline or further away from the centerline of the oncoming sheet material. In order to adjust the location of the right drive roller 51, push-button PB5-2 can be momentarily closed to provide a signal to the scanners, if desired. In addition, when normally open push-button PB3 is closed, the operation of the brake and clutch can be "jogged" to adjust the position of the sheet material in the machine.

When control relay CR2a of conductors 184 and 185 have been energized, the normally open relay switch CR2a-1 is closed in conductor 196, causing a circuit to be made from conductor 178, through normally closed relay switch CR8-1, switch CR2a-1, and through time-delay relay TR2. After a time delay, time-delay relay TR2 closes its relay switch TR2-1 to make a circuit through conductor 198 to control relay CR4 and through conductor 199. Control relay CR4 then closes its normally open relay switch CR4-NO and opens its normally closed relay switch CR4-NC. This opens a circuit through conductor 200, through switch CR4-NC, conductor 201 and solenoid brake 110, while making a circuit through conductor 200, switch CR4-NO, conductor 202 and clutch 64. This initiates the rotation of drive roller 52.

In the meantime, the circuit made through conductor 199, conductor 204, normally closed push-button PB6-1, conductor 205, conductor 206 and scanners 128, through solenoid valves SV-3 and SV-4. When the scanners 128 detect the lateral movement of the sheet material beyond the range of the scanners, one or the other of the solenoid valve SV-3 and SV-4 is energized so as to cause cylinder 130 to adjust the position of the drive roller 52. Also, adjustment to the position of the left edge portion of the sheet material can be made by actuating normally open jog switch PB4 and PB6-2.

When a signal has been received from the counters CTR3 and CTR4, the control relays CR7 and CR8 are energized in the 12-volt circuit through conductors 219 and 220, and control relay CR7 opens normally closed relay switch CR7-1 to terminate the feeding and lateral adjustment of the system, and normally open relay switch CR7-2 is closed. Also, control relay CR8 closes normally open relay switch CR8-2, making a circuit through conductor 209 through normally open relay switch CR2a-2 which has been closed by the latching circuit from control relay CR2, to the solenoid valve SV-5 of the sheet-engaging cylinders 155 and 156 and the pivot cylinders 160 which pivot the sheet-engaging cylinders 155 and 156. This causes the sheet material to be gripped against the backing plate and to be stretched laterally away from the longitudinal centerline of the sheet material.

In the meantime, a circuit is made from conductor 209 through conductor 210 to time-delay relay TR3. After a time delay, relay coil TR3 closes its normally open relay switch TR3-1 which makes a circuit through conductor 211, switch TR3-1, safety switch TS1, and control relay CR5. When control relay coil CR5 is energized, its normally closed relay switch CR5-NC is opened and its normally open relay switch CR5-NO is closed. This results in the circuit through conductor 212 and normally closed switch CR5-NC to brake 79 being opened while resulting in a circuit being made through conductor 212, switch CR5-NO and clutch 65. This causes the connector rod 75 to oscillate through one complete cycle, causing the cutting blade 56 to move through its cutting stroke and back to its ready position. In the meantime, a circuit is made through conductor 212, switch CR5-NO, conductor 213 through counter CT1. The counter counts the cycles of the cutting blade.

Conductor 214 makes a circuit through one of the photoelectric cells 32, while the conductor 215 makes a circuit through the other photoelectric cell 32, and the cells 32 control the solenoid valves SV-6 and SV-7 which regulate the flow of fluid to the fluid-operated cylinder 31, which adjusts the lateral position of the sheet material as it moves from behind the towel cutter up over the top of the towel cutter.

When the sensing means 141 and 142 detect a thin area in the sheet material (FIG. 5), circuits are made to the counters CTR1, CTR2, CTR3 and CTR4 in the 12-volt circuit. When the thin band in the sheet material is long enough so that counters CTR1 and CTR2 count high enough, signals are passed from counters CTR1 and CTR2 to counters CTR3 and CTR4, and when counters CTR3 and CTR4 count to a predetermined number the control relays CR7 and CTR8 are energized by conductors 219 and 220, thereby opening normally closed relay switches CR7-1 and CR8-1 and terminating the feed of drive rollers 51 and 52. If one of the counters CTR3 or CTR4 starts its counting function earlier than the other counter because the band in the sheet material is not oriented at a right angle with respect to the longitudinal centerline of the material, the leading edge of the sheet material will be stopped at the cutting station first to allow the trailing edge to become aligned at the cutting station. Also, the stretch and cut circuit is closed by control relays CR7 and CR8, which results in stopping both edge portions of the sheet material and forming the cut through the sheet material.

In the meantime, the proximity switch 78 on the knife-shaft or axle 72 detects the presence of lobe 76 and makes a circuit through conductor 218, cell 78, and the cell makes a circuit to conductor 219 which resets counters CTR1, CTR2, CTR3 and CTR4, so the system is ready for another cycle.

While the system has been disclosed as detecting relatively thin areas of the sheet material, as, for example, the unfilled band of terry cloth towel material, it will be understood by those skilled in the art that the bands that can be detected could be bands of contrasting color, or bands of different density material, and the like. The sensing means could be, for example, a color detector or a sensor of the type that would detect the relative hardness and softness of material, and the resulting cut could be made in the band of contrasting color or contrasting density, etc.

While this application has been described in detail with particular reference to a preferred embodiment thereof, it will be understood that variations and modifications can be effected within the spirit and scope of the invention as described hereinbefore and as defined in the appended claims.

We claim:

1. A method of cutting sheet material across its length, the sheet material having bands of varying thickness extending across its length comprising the steps of advancing the material from a supply along its length through a predetermined path toward a cutting station; detecting variances in the thickness of the sheet material at opposite edge portions of the sheet material at predetermined positions ahead of the cutting station; stopping each edge portion of the sheet material independently of the other edge portion at the cutting station in response to detecting a variance in the thickness at an edge portion; pulling the sheet material at the cutting station taut across its length; cutting across the sheet material at the cutting station while the sheet material is pulled taut.

2. The method of claim 1 and wherein the step of detecting variances in the thickness of the sheet material at opposite edge portions of the sheet material comprises maintaining base roll members adjacent the path at the edge portions of the sheet material, urging follower roll members into the edge portions of the sheet material toward the base roll members, and detecting movement of the follower rollers as variances in the thickness of the sheet material move between the base roll members and the follower roll members.

3. The method of claim 2 and wherein the step of maintaining the base roll members adjacent the path at the edge portions of the sheet material comprises detecting the lateral movement of the edges of the sheet material as the sheet material moves along its length toward the cutting station, and in response to detecting the lateral movement of an edge of the sheet material moving a base roll at the moved edge laterally in the same direction.

4. The method of claim 1 and wherein the bands of varying thickness are also of varying length extending along the length of the sheet material, and wherein the step of stopping each edge portion of the sheet material comprises stopping the movement of the sheet material in response to detecting a variance in the thickness of the sheet material of a length greater than a predetermined length.

5. The method of claim 1 and wherein the step of pulling the sheet material taut across its length at the cutting station comprises grasping the sheet material at its opposite edge portions and on opposite sides of the cutting station and pulling laterally away from the centerline of the sheet material.

6. The method of claim 5 and wherein the step of grasping the sheet material is accomplished after the movement of the sheet material has been stopped.

7. The method of claim 5 and wherein the step of grasping the sheet material comprise moving foot members into engagement with the sheet material and against a backing plate at positions located on opposite sides of the cutting station and at opposite edge portions of the sheet material, and wherein the step of pulling the sheet material taut comprises moving the foot members laterally away from the centerline of the sheet material.

8. A method of cutting sheet material having a plurality of spaced bands extending across its length comprising the steps of advancing the sheet material at its opposite edge portions along its length through a predetermined path toward a cutting station, detecting a band in the sheet material at opposite edge portions of the sheet material as the band approaches the cutting station, in response to detecting the band at opposite edge portions stopping each edge portion of the sheet material independently of the other edge portion at the cutting station with the opposite edge portions of the band aligned with the cutting station, stretching the sheet material at the cutting station in a direction extending across the length of the sheet material to align the filler threads of the sheet material with the cutting station, and cutting across the sheet material at the cutting station.

9. The method of claim 8 and further including the step of relaxing the sheet material at the cutting station after it has been cut.

10. The method of claim 8 and wherein the step of detecting a band in the sheet material comprises detecting a band of a thickness different from the rest of the sheet material.

11. The method of claim 8 and wherein the bands extending across the length of the sheet material vary in length extending along the length of the sheet material, and wherein the step of stopping each edge portion of the sheet material comprises stopping the movement of each edge portion in response to detecting a band at each edge portion of a length greater than a predetermined length.

12. Apparatus for cutting sheet material across its length, the sheet material having bands extending across its length comprising: cutting means; a pair of conveying means for engaging the edge portions of the sheet material and advancing the sheet material along its length through a predetermined path toward said cutting means; detecting means at opposite edges of the path for detecting the opposite edge portions of a band on the sheet material moving toward said cutting means; control means responsive to said detecting means for independently stopping each said conveying means to position the opposite edge portions of said band a predetermined distance from said detecting means at said cutting means; and, stretching means at said cutting station for pulling the sheet material taut across its length at said cutting station.

13. The apparatus of claim 12 and further including a pair of positioning means, one at each edge portion of the path of the sheet material, for moving the pair of conveying means toward and away from the centerline of the path of the sheet material.

14. The apparatus of claim 12 and wherein said stretching means comprises backing plate means positioned on one side of the path of the sheet material, movable sheet engaging members positioned on the other side of the path of the sheet material at opposite edge portions of the sheet material and on opposite sides of said cutting means, said movable sheet engaging means being movable into the sheet material and biased toward engagement with said backing plate means and movable away from the centerline of the sheet material while biased toward engagement with said backing sheet to pull the sheet material taut across its length on opposite sides of said cutting means.

15. The apparatus of claim 14 and further including a pair of positioning means, one at each edge portion of the path of the sheet material, for moving the pair of conveying means and the movable sheet engaging members toward and away from the centerline of the path of the sheet material.

* * * * *